US008382462B2

(12) United States Patent
Kishi et al.

(10) Patent No.: US 8,382,462 B2
(45) **Date of Patent: *Feb. 26, 2013**

(54) VANE PUMP WITH CIRCULATING OIL SUPPLY PASSAGE

(75) Inventors: Yoshinobu Kishi, Toyota (JP); Kikuji Hayashida, Toyota (JP); Kiyotaka Ohtahara, Toyota (JP)

(73) Assignee: Taiho Kogyo Co., Ltd., Toyota-shi, Aichi (JP)

( * ) Notice: Subject to any disclaimer, the term of this patent is extended or adjusted under 35 U.S.C. 154(b) by 253 days.

This patent is subject to a terminal disclaimer.

(21) Appl. No.: 12/924,778

(22) Filed: Oct. 5, 2010

(65) Prior Publication Data

US 2011/0064598 A1 Mar. 17, 2011

Related U.S. Application Data

(63) Continuation of application No. 11/884,216, filed as application No. PCT/JP2006/301554 on Jan. 31, 2006, now Pat. No. 7,896,631.

(30) Foreign Application Priority Data

Feb. 16, 2005 (JP) ..... 2005-39641

(51) Int. Cl.

| | |
|---|---|
| ***F03C 4/00*** | (2006.01) |
| ***F04C 15/00*** | (2006.01) |
| ***F04C 2/00*** | (2006.01) |
| ***F04C 27/02*** | (2006.01) |

(52) U.S. Cl. ..... 418/94; 418/98; 418/188; 418/255; 418/270

(58) Field of Classification Search ..... 418/93, 418/94, 96–100, 106, 188, 253–255, 259, 418/266–268, 270

See application file for complete search history.

(56) References Cited

U.S. PATENT DOCUMENTS

| | | | | |
|---|---|---|---|---|
| 7,628,595 | B2 * | 12/2009 | Ono et al. | 418/255 |
| 7,896,631 | B2 * | 3/2011 | Kishi et al. | 418/255 |

FOREIGN PATENT DOCUMENTS

| | | | |
|---|---|---|---|
| JP | 49142608 | U * | 9/1974 |
| JP | 05149282 | A * | 6/1993 |
| JP | 2003239882 | A * | 8/2003 |
| JP | 2004011421 | A * | 1/2004 |
| WO | WO 2005085645 | A1 * | 9/2005 |

OTHER PUBLICATIONS

Note that JP05149282 (A), Hertell et al. , Vane Type Vacuum Pump, Jun. 15, 1993 , also published as JP 3107906 (B2), Hertell et al. , Vane Type Vacuum Pump, Nov. 13, 2000.*

* cited by examiner

*Primary Examiner* — Theresa Trieu
(74) *Attorney, Agent, or Firm* — Flynn, Thiel, Boutell & Tanis, P.C.

(57) ABSTRACT

An oil supply groove in communication with a pump room is formed above a bearing of a housing, and an open air groove in communication with atmospheric air is formed at a position rotated around the bearing by 90° from the oil supply groove. In a shank of a rotor, a branch passage branching from an oil passage formed in its axial direction to the diametrical direction of the shank and an open air passage formed in the direction perpendicular to the branch passage are formed. The branch passage and the oil supply groove communicate with each other while the open air passage and the open air groove are arranged to also communicate with each other.

1 Claim, 3 Drawing Sheets

VANE PUMP WITH CIRCULATING OIL SUPPLY PASSAGE

CROSS-REFERENCE TO RELATED APPLICATIONS

This application is a continuation of prior U.S. application Ser. No. 11/884,216, filed Aug. 10, 2007 now U.S. Pat. No. 7,896,631, which was the National Stage of International Application No. PCT/JP2006/301554, filed Jan. 31, 2006.

TECHNICAL FIELD

The present invention relates to a vane pump, and in particular to a vane pump in which an oil supply passage where a lubricating oil circulates is formed in a rotor and which feeds the lubricating oil intermittently into a pump room owing to rotation of the rotor.

BACKGROUND OF THE INVENTION

Conventionally, there is known a vane pump which includes: a housing having an approximately circular pump room; a rotor which rotates at an eccentric position relative to the center of the pump room; and a vane rotated by the rotor for dividing the pump room full-time into a plurality of spaces.

Then, in order to lubricate such a vane pump, there is known a vane pump configured in a manner that an oil supply passage which intermittently communicates with the pump room owing to rotation of the rotor described above is formed in the rotor, and a lubricating oil is intermittently fed from the oil supply passage into the pump room (Patent Document 1).

However, in the case of the vane pump having such oil supply passage, when the rotor stops with the oil supply passage being in communication with the pump room, then owing to a negative pressure in the pump room, the lubricating oil in the oil supply passage is sucked down into the pump room, and when the vane pump, subsequently, gets started, the vane may be damaged by an excessive load which is applied to the vane to discharge this lubricating oil.

To address such a problem, there is known a technology that an air passage constantly communicating with an atmospheric air is formed in the oil supply passage, and when the rotor stops, a negative pressure in the pump room is eliminated by sucking an atmospheric air into the pump room through the air passage, thereby a large amount of the lubricating oil is prevented from flowing into the pump room (Patent Document 2).

Patent Document 1: Japanese Patent No. 3107906 (particularly see paragraph 0022)

Patent Document 2: Japanese Patent Laid-Open No. 2003-239882 (particularly see paragraph 0012)

DISCLOSURE OF THE INVENTION

Issues to be Solved by the Invention

In such a manner, according to Patent Document 2 above, owing to the air passage described above, a large amount of lubricating oil is prevented from flowing into the pump room, but on the contrary, because this air passage is in communication with an atmospheric air at all time, there arose a problem that, during operation of a vane pump, the lubricating oil constantly flows outwardly from the air passage.

The present invention, in view of such problems, aims to provide a vane pump in which, at the stop of a rotor, a lubricating oil can be prevented from flowing into a pump room, and an amount of the lubricating oil flowing outwardly during operation of the vane pump can be controlled.

Means to Solve the Issues

Therefore, the vane pump according to one embodiment is a vane pump including: a housing having an approximately circular pump room; a rotor which rotates at an eccentric position relative to the center of the pump room; and a vane rotated by the rotor, for dividing the pump room full-time into a plurality of spaces, wherein, in the rotor, an oil supply passage intermittently communicating with the pump room owing to rotation of the rotor is formed, and a lubricating oil is intermittently fed through the oil supply passage to the pump room, characterized in that, in the rotor, an air passage is formed, and when the oil supply passage becomes in communication with the pump room due to rotation of the rotor, the air passage makes the pump room communicate with the outside of the housing.

Further, the vane pump according to another embodiment is a vane pump including: a housing having an approximately circular pump room; a rotor which rotates at an eccentric position relative to the center of the pump room; and a vane rotated by the rotor, for dividing the pump room full-time into a plurality of spaces, wherein, in the rotor, an oil supply passage communicating with the pump room is formed, characterized in that, in the rotor, an air passage for making the oil supply passage communicate with the outside of the housing is formed, in the air passage, a check valve is provided, and when the rotor stops with the oil supply passage being in communication with the pump room, and a pressure in the oil supply passage becomes negative owing to a negative pressure in the pump room, then the check valve is released to allow a gas to flow into the pump room through the air passage.

Effect of the Invention

According to one embodiment of the present invention, when the vane pump stops with the oil supply passage being in communication with the pump room, a gas flows into the pump room through the air passage, thereby a negative pressure in the pump room is eliminated and a lubricating oil may not flow into the pump room in large quantities.

Further, the air passage, during operation of the vane pump, similarly as the oil supply passage intermittently communicates with the pump room, is adapted to only intermittently communicate with the pump room, and further, according to claim 3 of the present invention, the air passage has an orifice passage provided therein, thereby an amount of the lubricating oil flowing outwardly from the air passage can be controlled to the minimum.

Moreover, according to another embodiment of the present invention, when the vane pump stops with the oil supply passage being in communication with the pump room, the check valve is opened to direct a gas into the pump room through the air passage, thereby a negative pressure in the pump room can be eliminated and a lubricating oil can be prevented from flowing into the pump room.

Further, owing to the check valve, the air passage is configured to open only when the pump room has a negative pressure, and therefore, during operation of the vane pump, a lubricating oil can be prevented from flowing outwardly from the air passage.

BEST MODE FOR CARRYING OUT THE INVENTION

Now, embodiments shown in drawings will be hereinafter described. FIGS. 1, 2 show a vane pump 1 of a first embodiment according to the present invention. This vane pump 1 is fixed on the side surface of an engine in an automobile not shown, and is configured to generate a negative pressure in a booster of a brake control system not shown.

This vane pump 1 includes: a housing 2 having an approximately circular pump room 2A formed thereon; a rotor 3 which is rotated at an eccentric position relative to the center of the pump room 2A by a driving force of the engine; a vane 4 rotated by the rotor 3 and for dividing the pump room 2A full-time into a plurality of spaces; and a cover 5 for covering the pump room 2A.

In the housing 2, an intake passage 6 located above the pump room 2A, in communication with the booster of the brake control system and for sucking in a gas from the booster is provided, and an exhaust passage 7 located below the pump room 2A, for discharging the gas sucked in from the booster is provided, respectively. Then, in the intake passage 6, a check valve 8 is provided to maintain the booster in a negative pressure, especially when the engine stops.

Describing in detail with reference to FIG. 1, the rotor 3 includes a cylindrical rotor portion 3A which rotates in the pump room 2A, an outer surface of the rotor portion 3A is arranged to contact with an inner surface of the pump room 2A, the intake passage 6 is situated upstream to rotation of the rotor portion 3A, and the exhaust passage 7 is formed downstream to the rotor portion 3A.

Further, in the rotor portion 3A, a groove 9 is formed in the diametrical direction, and the vane 4 is configured to move slidably along in the groove 9 in the direction perpendicular to the axial direction of the rotor 3. Then, between a hollow portion 3*a* formed in a central portion in the rotor portion 3A and the vane 4, a lubricating oil is arranged to flow in from an oil supply passage described below.

Further, at both ends of the vane 4, caps 4*a* are provided, and, by rotating the caps 4*a* while these caps 4*a* are constantly brought into slidable contact with the inner surface of the pump room 2A, the pump room 2A is divided into two or three spaces full-time.

Specifically, in a situation shown in FIG. 1, the pump room 2A is divided by the vane 4 in the horizontal direction as shown, and further in a space on the right side in FIG. 1, the pump room is divided in the vertical direction by the rotor portion 3A, so that the pump room 2A is divided into three spaces in total.

When, from this situation shown in FIG. 1, the vane 4 rotates to the vicinity of a position at which the center of the pump room 2A and the center of rotation of the rotor portion 3A are linked to each other, the pump room 2A gets divided into two spaces, which are a space on the side of the intake passage 6 and a space on the side of the exhaust passage 7.

FIG. 2 shows a cross-sectional view taken along the line II-II in FIG. 1, and in FIG. 2, a bearing 2B for supporting a shank 3B constituting the rotor 3 is formed on the right side shown of the pump room 2A of the housing 2, and the shank 3B is configured to rotate integrally with the rotor portion 3A.

Further, on a left end of the pump room 2A, a cover 5 is provided, left side end surfaces shown of the rotor portion 3A and the vane 4 are configured to rotate slidably in contact with this cover 5, and further a right side end surface of the vane 4 is configured to rotate slidably in contact with the inner surface of the pump room 2A on the side of the bearing 2B.

Also, a bottom surface 9*a* of the groove 9 formed in the rotor 3 is formed on the side of the shank 3B slightly away from a surface at which the vane 4 slidably contacts with the pump room 2A, so that a gap is formed between the vane 4 and the bottom surface 9*a*.

Further, the shank 3B projects from the bearing 2B of the housing 2 to the right side shown, at this projected position, a coupling 10 rotated by a camshaft of the engine is linked, and the rotor 3 is configured to rotate by rotation of the camshaft.

Then, in the shank 3B, an oil passage 11 for circulating a lubricating oil and constituting an oil supply passage is formed in its central portion, and this oil passage 11 branches at a predetermined position in the diametrical direction of the shank 3B and includes a branch passage 11*a* open into an outer surface of the shank 3B.

Further, in the bearing 2B, an oil supply groove 12 constituting the oil supply passage formed to make the pump room 2A and the branch passage 11*a* communicate with a sliding portion along the shank 3B is formed, and in this embodiment, the oil supply groove 12 is formed on the upper side of the bearing 2B shown in FIG. 2.

Owing to such a configuration, when an opening of the branch passage 11*a* coincides with the oil supply groove 12 as shown in FIG. 2, the lubricating oil from the oil passage 11 flows into the pump room 2A through the oil supply groove 12, and through the gap between the vane 4 and the bottom surface of the groove 9, and flows into the hollow portion 3*a* of the rotor 3.

Then, in the vane pump of this embodiment, at a position between the branch passage 11*a* in the oil passage 11 and an opening on the side of the engine, an open air passage 13 constituting an air passage is formed in the direction perpendicular to the branch passage 11*a*.

Further, FIG. 3 shows a cross-sectional view taken along the line III-III of FIG. 2. In the bearing 2B of the housing 2, an open air groove 14 for making the open air passage 13 communicate with an atmospheric air in the sliding portion along the shank 3B is formed.

This open air groove 14 is positioned at a position rotated around the bearing 2B by 90° from the oil supply groove 12, accordingly the branch passage 11*a* of the oil supply passage communicates with the oil supply groove, and at the same time, the open air passage 13 communicates with the open air groove 14.

Also, the open air passage 13 is formed as an orifice passage, and therefore, even when the lubricating oil is pushed onto an inner wall of the oil passage 11 due to an oil supply pressure and a centrifugal force by rotation of the rotor, the lubricating oil may not easily flow outwardly from the open air passage 13.

In addition, in this embodiment, the orifice passage is configured as the open air passage 13 to run through the bearing 2B, but instead of this, only a certain zone of the open air passage 13 from a connecting portion with the oil passage 12 may be an orifice passage, and an outside zone from the relevant orifice passage may be a diameter expansion passage.

Now, operation of the vane pump 1 having the configuration described above will be hereinafter described. Similarly to a conventional vane pump 1, rotation of the rotor 3 caused by operation of the engine rotates the vane 4 while the vane 4 reciprocates in the groove 9 of the rotor 3, and the spaces divided by the vane 4 in the pump room 2A change in volume depending on the rotation of the rotor 3.

As the result, in the space divided by the vane 4 on the side of the intake passage 6, its volume is increased to generate a negative pressure in the pump room 2A, and thereby, through the intake passage 6, a gas is sucked in from the booster to generate a negative pressure in the booster. Then, the gas sucked in, subsequently, is compressed by a decrease in volume of the space on the side of the exhaust passage 7 to be discharged from the exhaust passage 7.

On the one hand, the vane pump 1 gets started, concurrently, a lubricating oil is fed from the engine to the oil passage 11 formed on the rotor 3 at a predetermined pressure, and this lubricating oil is arranged to flow into the pump room 2A, when the branch passage 11*a* communicates with the oil supply groove 12 in the housing 2 due to rotation of the rotor 3.

The lubricating oil which flowed into the pump room 2A flows into the hollow portion 3*a* in the rotor portion 3A through the gap between the bottom surface 9*a* of the groove 9 formed on the rotor portion 3A and the vane 4, and this lubricating oil spouts from the gap between the rotor portion 3A and the groove 9, or the gap between the vane 4 and the cover 5 into the pump room 2A to lubricate them and seal the pump room 2A, and subsequently, the lubricating oil along with the gas is discharged from the exhaust passage 7.

Here, in the case of the vane pump 1 of this embodiment, even if the lubricating oil is pushed onto the inner wall of the oil passage 11 due to an oil supply pressure and a centrifugal force by rotation of the rotor 3, the lubricating oil may not easily flow outwardly, because the open air passage 13 is formed as the orifice passage.

Further, even if the lubricating oil flows outwardly from the orifice passage, because the open air passage 13 and the oil supply groove 12 communicate with each other only intermittently due to rotation of the rotor 3, an amount of the lubricating oil flowing outwardly from the open air passage 13 during operation of the vane pump 1 can be controlled to the minimum.

Moreover, when the lubricating oil is fed to the oil passage 11 at a predetermined pressure, because a pressure in the oil passage 11 is positive, an atmospheric air may not flow into through the open air passage 13, and for example, even if a supply pressure of the lubricating oil is low as immediately after the engine gets started, because an atmospheric air flows into the pump room 2A only intermittently, an ability to generate a negative pressure by the vane pump 1 may not be considerably deteriorated.

Then, subsequently, the engine is stopped, in response to it, the rotor 3 stops and suction by the booster ends.

Here, owing to the stopping of the rotor 3, the space divided by the vane 4 on the side of the intake passage 6 stops with being at a negative pressure, but, if the opening of the branch passage 11*a* and the oil supply groove 12 do not coincide with each other, the lubricating oil in the oil passage 11 may not flow into the pump room 2A.

On the contrary, if the rotor 3 stops when the opening of the branch passage 11*a* and the oil supply groove 12 coincide with each other, because the pump room 2A is at a negative pressure, the lubricating oil in the oil passage 11 will flow into the pump room 2A in large quantities.

Then, in this embodiment, the opening of the branch passage 11*a* and the oil supply groove 12 coincide with each other, at the same time, the open air passage 13 and the open air groove 14 are arranged to coincide with each other, and therefore the negative pressure in the pump room 2A is eliminated by sucking in an atmospheric air through this open air passage 13, thereby a large amount of the lubricating oil can be prevented from flowing into the pump room 2A.

Unlike the vane pump 1 of this embodiment described above, unfortunately in the case of the vane pump disclosed in Patent Document 1 above, when a rotor stops with an oil supply passage being in communication with a pump room, a lubricating oil in the oil supply passage will flow into the pump room in large quantities due to a negative pressure in the pump room, and subsequently, when an engine gets started, rotation of the vane is blocked by the lubricating oil which flowed into, which may lead to a damage of a vane.

Further, in the case of the vane pump in Patent Document 2, even if a rotor stops with an oil supply passage being in communication with a pump room, because an open air passage communicating full-time with an atmospheric air formed in the oil supply passage is formed, and a negative pressure in the pump room is eliminated due to an atmospheric air which will flow in through this open air passage, the lubricating oil does not flow into the pump room in large quantities.

However, unfortunately in this case disclosed in Patent Document 2, during operation of the vane pump, the lubricating oil flows outwardly through the open air passage due to an oil supply pressure and a centrifugal force by rotation of the rotor, resulting in a large amount of consumption of the lubricating oil during operation of the vane pump.

Moreover, because of constant communication with an atmospheric air, if a supply pressure of the lubricating oil from the engine is low, an atmospheric air flows into the pump room through the open air passage, accordingly the vane pump can not fully exhibit its performance.

FIG. 4 shows the result of measurement of consumption of the lubricating oil, when the vane pump 1 of this embodiment (example 1), the vane pump (a conventional vane pump 1) in which the open air passage is not provided, similarly to Patent Document 1, and the vane pump (a conventional vane pump 2) in which the open air passage is in constant communication with the oil supply passage, similarly to Patent Document 2, each vane pump is operated for a certain time period.

As the result of experiments, as obviously seen from FIG. 4, the consumption of lubricating oil in the example 1 is increased compared to that of the conventional vane pump 1 in which the lubricating oil may not flow outwardly through the open air passage, but it is seen that the consumption is decreased compared to that of the conventional vane pump 2.

Further, an amount of the lubricating oil which flowed into the pump room 2A was measured, when the oil passage 11 and the oil supply groove 12 coincided with each other with the engine being stopped, as the result, in the case of the conventional vane pump 1, the lubricating oil flowed into the pump room 2A to occupy over half the pump room 2A, but on the contrary, in the cases of the conventional vane pump 2 and the example 1, the lubricating oil which flowed into the pump room 2A did not occupy up to a third of it.

When the example 1 is compared to the conventional vane pump 1 in such a way, the consumption of the lubricating oil of the example 1 is larger than that of the conventional vane pump 1, but in the example 1, an amount of the lubricating oil flowing into the pump room 2A can be controlled to be less than that of the conventional vane pump 1 and the damage of the vane 4 described above can be effectively prevented.

Further, when the example 1 is compared to the conventional vane pump 2, their amounts of the lubricating oil flowing into the pump room 2A are equivalent, but the consumption of the lubricating oil of the example 1 can be controlled to be less than that of the conventional vane pump 2, and also, performance deterioration of the vane pump 1 at a low supply pressure of the lubricating oil, as described above, can be effectively prevented.

In addition, in the embodiment described above, the oil supply groove 12 is positioned above the bearing 2B, the open air groove 14 is positioned at a position rotated around the bearing 2B by 90° from the oil supply groove, and further the branch passage 11*a* and the open air passage 13 are oriented in the direction perpendicular to the diametrical direction of the shank 3B, but on the condition that a timing at which the branch passage 11*a* and the oil supply groove 12 coincide with each other and a timing at which the open air groove 13 and the open air groove 14 coincide with each other would occur at the same time, the oil supply groove 12 and the open air groove 14 may be formed at a different position, and correspondingly to it, the branch passage 11*a* and the open air passage 13 may be oriented in a different direction.

Next, a second embodiment of the present invention shown in FIG. 5 will be described. A vane pump 1 shown here, similarly to the first embodiment described above, includes a branch passage 11*a* which branches from an oil passage 11 provided in the central portion of a shank 3B of a rotor 3, and like components as those of the first embodiment described above, such as the branch passage 11*a*, will be described using like symbols hereinafter. In addition, FIG. 5 shows with a vane being omitted.

In this embodiment, an open air passage 13 and an open air groove 14 in a bearing 2B of a housing 2 similar to the first embodiment described above are not provided. Instead of those, an open air passage 21 of this embodiment is formed in the same direction as the axial direction of the rotor 3, and further formed to directly communicate with the branch passage 11*a* formed in the diametrical direction.

Moreover, in this open air passage 21, a check valve 22 is provided, a lubricating oil which flowed from an oil passage 11*a* into the open air passage 21 is arranged not to flow outwardly through the open air passage 21, and further in a coupling 10, a runout 10*a* is formed so that the open air passage 21 is not blocked.

Now, operation of the vane pump 1 having the configuration as described above will be described hereinafter. Similarly to the vane pump 1 of the embodiment described above, the vane pump 1 is operated due to operation of an engine and a gas is sucked in from a booster through an intake passage 6.

Then, while a lubricating oil is fed to the vane pump 1 at a predetermined pressure, the check valve 22 prevents the lubricating oil which flowed into the open air passage 21 from flowing outwardly.

Accordingly, similarly to the first embodiment, the lubricating oil which flows outwardly, because the open air passage 13 is in communication with the open air groove 14, can be reduced and an amount of the lubricating oil consumed can be reduced as much as that of the vane pump in Patent Document 1.

Next, the engine stops, and, similarly to the first embodiment, when the branch passage 11*a* coincides with the oil supply groove 12 in position, the lubricating oil is not fed at a predetermined pressure and further owing to a differential pressure between a pressure in the pump room 2A and an atmospheric pressure, a pressure in the oil passage 11 also becomes negative, then the check valve is opened to suck an atmospheric air into the pump room 2A, thereby a negative pressure in the pump room 2A is eliminated.

Therefore, the lubricating oil can be prevented from flowing into the pump room 2A in large quantities and a damage of a vane 4, as described above, can be avoided.

Also on the vane pump 1 of the second embodiment, experiments similar to the first embodiment were carried out and the result along with the experimental result of the example 1 is shown as an example 2 in FIG. 4.

As seen from the experimental result, in the case of the vane pump 1 of the example 2, because the lubricating oil which flowed into the open air passage 21 is prevented from flowing outwardly by the check valve 22, it is proved that an amount of consumption of the lubricating oil during operation of the engine is equivalent to that of the conventional vane pump 1 described above.

On the one hand, when the branch passage 11*a* and the oil supply groove 12 coincide with each other at the time of engine stop, because the check valve 22 is opened to suck an atmospheric air into the pump room 2A, similarly to the vane pump 1 of the example 1, an amount of the lubricating oil which flowed into the pump room 2A did not occupy up to a third of the pump room 2A.

In this manner, in the case of the example 2, the amount of consumption of the lubricating oil can be equivalent to that of the conventional vane pump 1, and further the amount of the lubricating oil which flows into the pump room 2A at stop of the engine can be also equivalent to that of the conventional vane pump 2.

In addition, in each embodiment described above, the description has been provided using the vane pump 1 including one vane 4, but obviously, the present invention may be also applied to a vane pump 1 including a plurality of vanes 4 conventionally known, and application thereof is not limited only to generation of a negative pressure in a booster.

DESCRIPTION OF SYMBOLS

Figure 1:
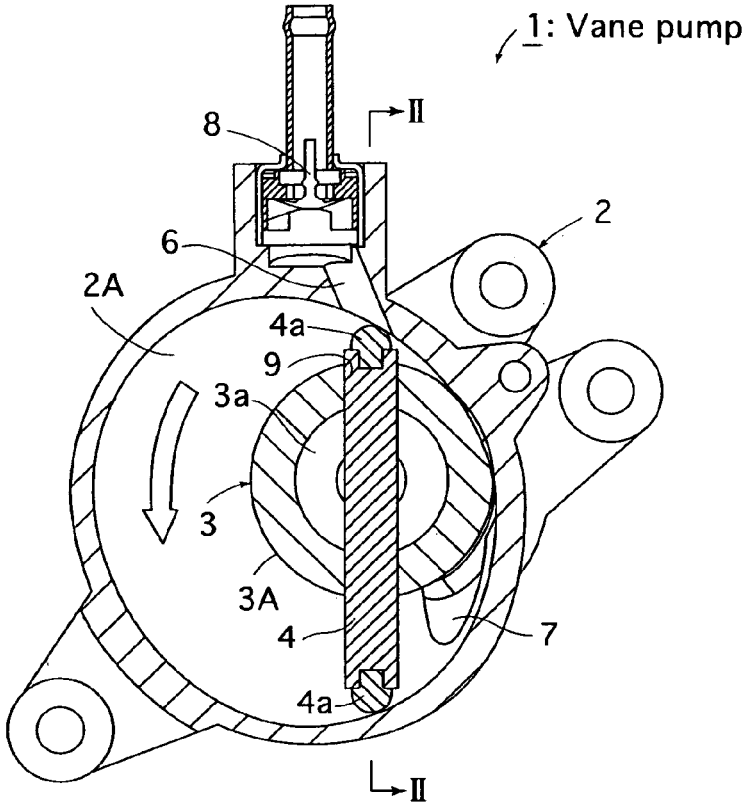
FIG. 1 is an elevation view of a vane pump of a first embodiment.
Figure 2:
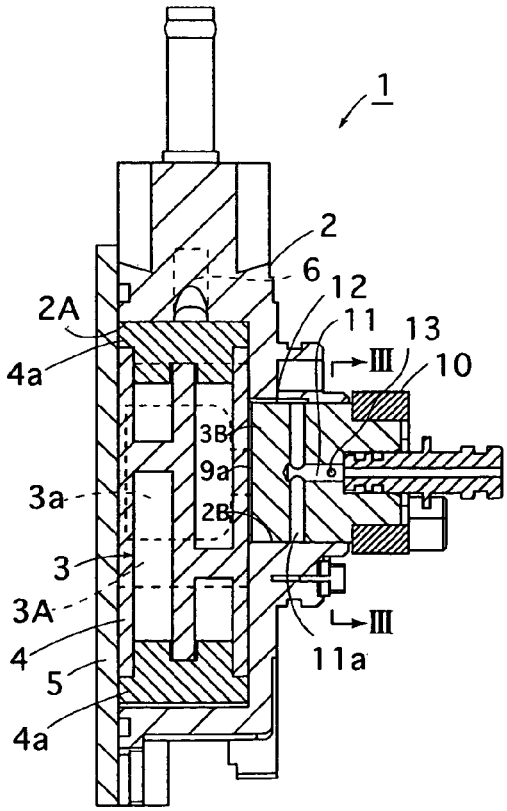
FIG. 2 is a cross-sectional view taken along the line II-II in FIG. 1.
Figure 3:
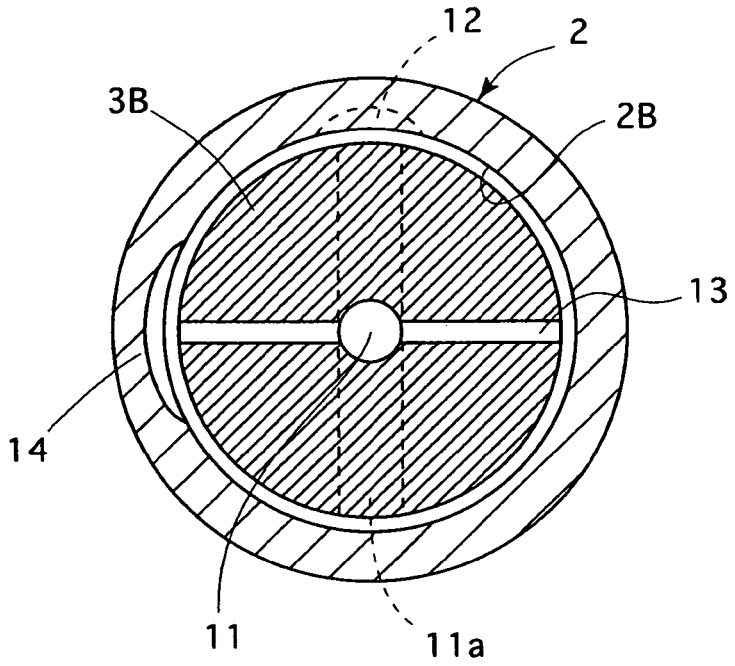
FIG. 3 is a cross-sectional view taken along the line III-III in FIG. 2.
Figure 4:
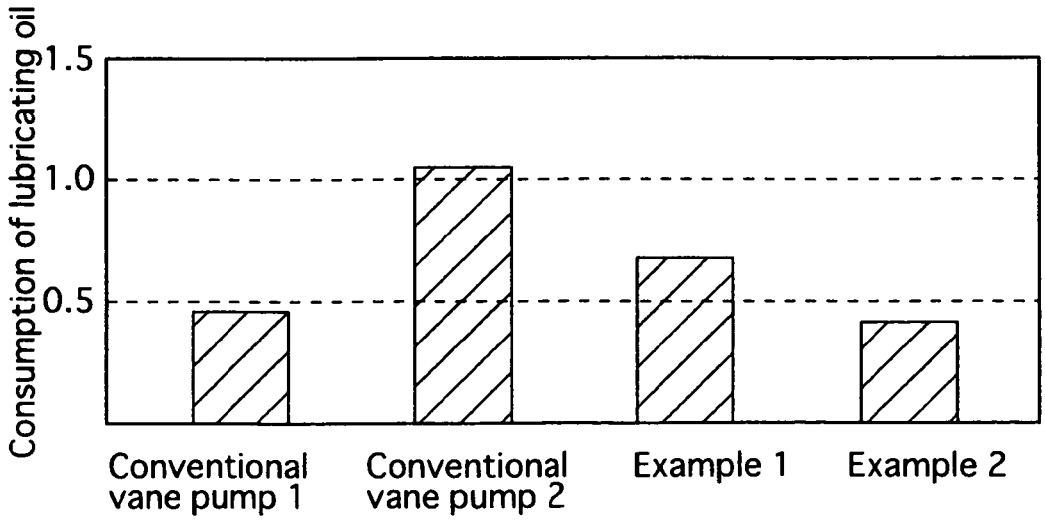
FIG. 4 is a view illustrating an experimental result on the present invention.
Figure 5:
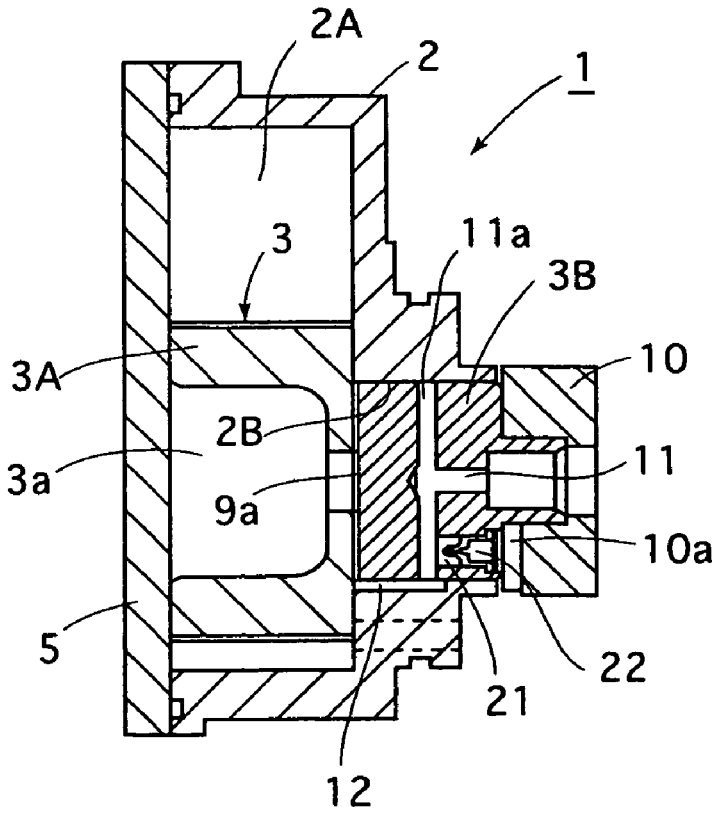
FIG. 5 is a cross-sectional view of a vane pump of a second embodiment.

1 vane pump
2 housing
2A pump room
2B bearing
3 rotor
3A rotor portion
3B shank
4 vane
11 oil passage
11*a* branch passage
12 oil supply groove
13 open air passage
14 open air groove
21 open air passage
22 check valve

What is claimed is:

1. A vane pump comprising:

a housing having an approximately circular pump room with a center;

a rotor which rotates at an eccentric position relative to the center of the pump room, the rotor comprising a rotor portion for holding a vane;

a shank for rotationally driving the rotor portion;

a bearing for supporting the shank, the bearing located in the housing;

a vane rotated by the rotor and dividing the pump room into a plurality of spaces;

an oil supply passage in intermittent communication with the pump room due to the rotation of the rotor, the oil supply passage comprising an oil supply groove formed on an inner surface of the bearing in the axial direction and opening into the pump room;

an oil conveyance passage formed in the shank and having a branching passage at a position adjacent the pump room and configured such that when the branching passage coincides with the oil supply groove as the rotor rotates, lubricating oil is fed into the pump room;

an air passage in fluid communication with the pump room and air outside of the housing when the oil supply passage is in communication with the pump room, the air passage comprising an open air passage in the shank, the open air passage being located in a different axial location relative to the oil conveyance passage, the air passage being in communication with a gas outside the housing; and a check valve attached to the open air passage that selectively allows a gas to flow inwardly into the pump room at a desired time, the open air passage being formed on the shank in the axial direction, a first end of the open air passage being in communication with the branching passage and a second end of the open air passage having an opening for communication with a gas outside the housing, and the vane pump being configured such that when the rotor stops and the oil supply passage is in fluid communication with the pump room and a fluid pressure in the oil supply passage is negative due to a negative pressure in the pump room, the check valve is released to allow a gas to flow into the pump room through the air passage.

* * * * *